US009425513B2

(12) United States Patent
Oh et al.

(10) Patent No.: US 9,425,513 B2
(45) Date of Patent: Aug. 23, 2016

(54) LENS WITH SPATIAL MIXED-ORDER BANDPASS FILTER

(71) Applicant: Samsung Electronics Co., Ltd., Suwon-si, Gyeonggi-do (KR)

(72) Inventors: Jungsuek Oh, Fairview, TX (US); George Zohn Hutcheson, Richardson, TX (US)

(73) Assignee: Samsung Electronics Co., Ltd., Suwon-si (KR)

( * ) Notice: Subject to any disclaimer, the term of this patent is extended or adjusted under 35 U.S.C. 154(b) by 61 days.

(21) Appl. No.: 14/293,985

(22) Filed: Jun. 2, 2014

(65) Prior Publication Data

US 2015/0009080 A1 Jan. 8, 2015

Related U.S. Application Data

(60) Provisional application No. 61/843,749, filed on Jul. 8, 2013.

(51) Int. Cl.

| | |
|---|---|
| ***H01Q 19/06*** | (2006.01) |
| ***H01Q 15/02*** | (2006.01) |
| ***H01Q 15/00*** | (2006.01) |
| ***H01Q 15/10*** | (2006.01) |

(52) U.S. Cl.

CPC ..... *H01Q 19/062* (2013.01); *H01Q 15/0026* (2013.01); *H01Q 15/10* (2013.01)

(58) Field of Classification Search

CPC ..... H01Q 15/02; H01Q 19/06
USPC ..... 343/753, 700 MS, 904, 910
See application file for complete search history.

(56) References Cited

U.S. PATENT DOCUMENTS

| | | | | |
|---|---|---|---|---|
| 2,849,713 | A | 8/1958 | Robinson, Jr. | |
| 4,721,966 | A | 1/1988 | McGrath | |
| 5,373,302 | A * | 12/1994 | Wu | H01Q 5/45 343/781 CA |
| 5,497,169 | A * | 3/1996 | Wu | H01Q 15/0033 333/134 |
| 5,900,847 | A | 5/1999 | Ishikawa et al. | |
| 6,396,451 | B1 * | 5/2002 | Wu | G01Q 15/24 343/756 |
| 6,822,622 | B2 * | 11/2004 | Crawford | H01Q 15/002 343/754 |

(Continued)

FOREIGN PATENT DOCUMENTS

JP 2012-060440 A 3/2012

OTHER PUBLICATIONS

International Search Report dated Feb. 6, 2015 in connection with PCT Patent Application No. KR2014/009847, 3 pages.

(Continued)

*Primary Examiner* — Huedung Mancuso

(57) ABSTRACT

An apparatus includes a plurality of layers of conductive elements and a substrate layer. A first of the layers of conductive elements has a first portion that includes conductive elements having a first structure different from a second structure of conductive elements in a second portion of the first layer. The first layer can be in contact with one side of the substrate layer. Conductive elements in a second of the layers of conductive elements can be in contact with another side of the substrate layer. The lens may include a first type of unit cell including at least one conductive element having the first structure and conductive elements having the second structure positioned on different sides of the substrate layer. The first type of unit cell may provide a capacitively-loaded bandpass filter response, and a second type of unit cell may provide a bandpass filter response.

20 Claims, 7 Drawing Sheets

(56) References Cited

U.S. PATENT DOCUMENTS

| | | | | |
|---|---|---|---|---|
| 7,071,889 | B2 * | 7/2006 | McKinzie, III | H01Q 9/0421 343/700 MS |
| 7,420,524 | B2 * | 9/2008 | Werner | H01Q 1/38 343/700 MS |
| 7,821,473 | B2 | 10/2010 | Justice et al. | |
| 8,120,546 | B2 | 2/2012 | Smith et al. | |
| 2002/0057222 | A1 | 5/2002 | McKinzie et al. | |
| 2006/0125578 | A1 | 6/2006 | Akale et al. | |
| 2009/0058746 | A1 * | 3/2009 | Delgado | H01Q 15/0013 343/770 |
| 2010/0220035 | A1 | 9/2010 | Lee et al. | |
| 2010/0283557 | A1 | 11/2010 | Taniguchi | |
| 2011/0210903 | A1 | 9/2011 | Sarabandi et al. | |
| 2012/0169554 | A1 | 7/2012 | Behdad et al. | |
| 2012/0280872 | A1 | 11/2012 | Werner et al. | |
| 2012/0313730 | A1 | 12/2012 | Ootsuka | |

OTHER PUBLICATIONS

Written Opinion of the International Searching Authority dated Feb. 6, 2015 in connection with PCT Patent Application No. KR2014/009847, 9 pages.

J.J.Lee; "Dielectric Lens Shaping and Coma-Correction Zoning"; IEEE Transactions on Antennas and Propagation; vol. AP-31, No. 1; Jan. 1983; pp. 211-216.

D.M. Pozar; "Flat lens antenna concept using aperture coupled microstrip patches"; Electronics Letters; Nov. 7, 1996; vol. 32, No. 23; pp. 2109-2111.

Iyer, et al.; "A Multilayer Negative-Refractive-Index Transmission-Line (NRI-TL) Metamaterial Free-Space Lens at X-Band"; IEEE Transactions on Antennas and Propagation, vol. 55, No. 10; Oct. 2007; pp. 2746-2753.

Al-Joumayly, et al.; "A New Technique for Design of Low-Profile, Second-Order, Bandpass Frequency Selective Surfaces"; IEEE Transactions on Antennas and Propagation, vol. 57, No. 2; Feb. 2009; pp. 452-459.

Al-Joumayly, et al.; "A Generalized Method for Synthesizing Low-Profile, Band-Pass Frequency Selective Surfaces with Non-Resonant Constituting Elements"; IEEE Transactions on Antennas and Propagation, vol. 58, No. 12; Dec. 2010; pp. 4033-4041.

Al-Joumayly, et al.; "Wideband Planar Microwave Lenses using Sub-Wavelength Spatial Phase Shifters"; IEEE Transactions on Antennas and Propagation, vol. 59, No. 12; Dec. 2011; pp. 4542-4552.

* cited by examiner

LENS WITH SPATIAL MIXED-ORDER BANDPASS FILTER

CROSS-REFERENCE TO RELATED APPLICATION(S) AND CLAIM OF PRIORITY

This application claims priority under 35 U.S.C. §119(e) to U.S. Provisional Patent Application Ser. No. 61/843,749 filed on Jul. 8, 2013 and entitled "SINGLE-SUBSTRATE PLANAR LENS EMPLOYING SPATIAL MIXED-ORDER BANDPASS FILTER." The above-identified provisional patent document is hereby incorporated by reference in its entirety.

TECHNICAL FIELD

This application relates generally to wireless communication systems and, more specifically, to the use of a lens in electromagnetic (EM) wave transmissions.

BACKGROUND

A lens is an electronic device that can focus a planar wave front of EM waves to a focal point or, conversely, collimate spherical waves emitting from a point source to plane waves. Such fundamental characteristics are widely used in various applications, such as communication, imaging, radar, and spatial power combining systems. For example, in millimeter-wave frequency bands that fifth generation (5G) communication standards may employ, lenses have been paid considerable attention as a potential solution to overcome limits in gain and beam steering capabilities of antennas operating in such frequency bands.

SUMMARY

Embodiments of this disclosure provide lenses with spatial mixed-order bandpass filters and related systems and methods.

In one example embodiment, an apparatus includes a plurality of layers of conductive elements and a substrate layer. A first of the layers of conductive elements has a first portion that includes conductive elements having a first structure different from a second structure of conductive elements in a second portion of the first layer.

In another example embodiment, a method includes transmitting electromagnetic waves through a lens. The lens includes a plurality of layers of conductive elements and a substrate layer. A first of the layers of conductive elements has a first portion that includes conductive elements having a first structure different from a second structure of conductive elements in a second portion of the first layer.

In yet another example embodiment, a system includes a lens, at least one antenna, and a transmitter or transceiver. The lens includes a plurality of layers of conductive elements and a substrate layer. A first of the layers of conductive elements has a first portion that includes conductive elements having a first structure different from a second structure of conductive elements in a second portion of the first layer. The at least one antenna is configured to transmit or receive electromagnetic waves through the lens. The transmitter or transceiver is configured to generate signals for wireless transmission or receive signals transmitted wirelessly via the antenna.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description taken in conjunction with the accompanying drawings, in which like reference numerals represent like parts.

DETAILED DESCRIPTION

FIGS. 1 through 10B, discussed below, and the various embodiments used to describe the principles of this disclosure in this patent document are by way of illustration only and should not be construed in any way to limit the scope of the disclosure. Those skilled in the art will understand that the principles of this disclosure may be implemented in any suitably-arranged system or device.

Various figures described below may be implemented in wireless communication systems, possibly including those that use orthogonal frequency division multiplexing (OFDM) or orthogonal frequency division multiple access (OFDMA) communication techniques. However, the descriptions of these figures are not meant to imply physical or architectural limitations in the manner in which different embodiments may be implemented. Different embodiments of this disclosure may be implemented in any suitably-arranged communication systems using any suitable communication techniques.

Figure 1:
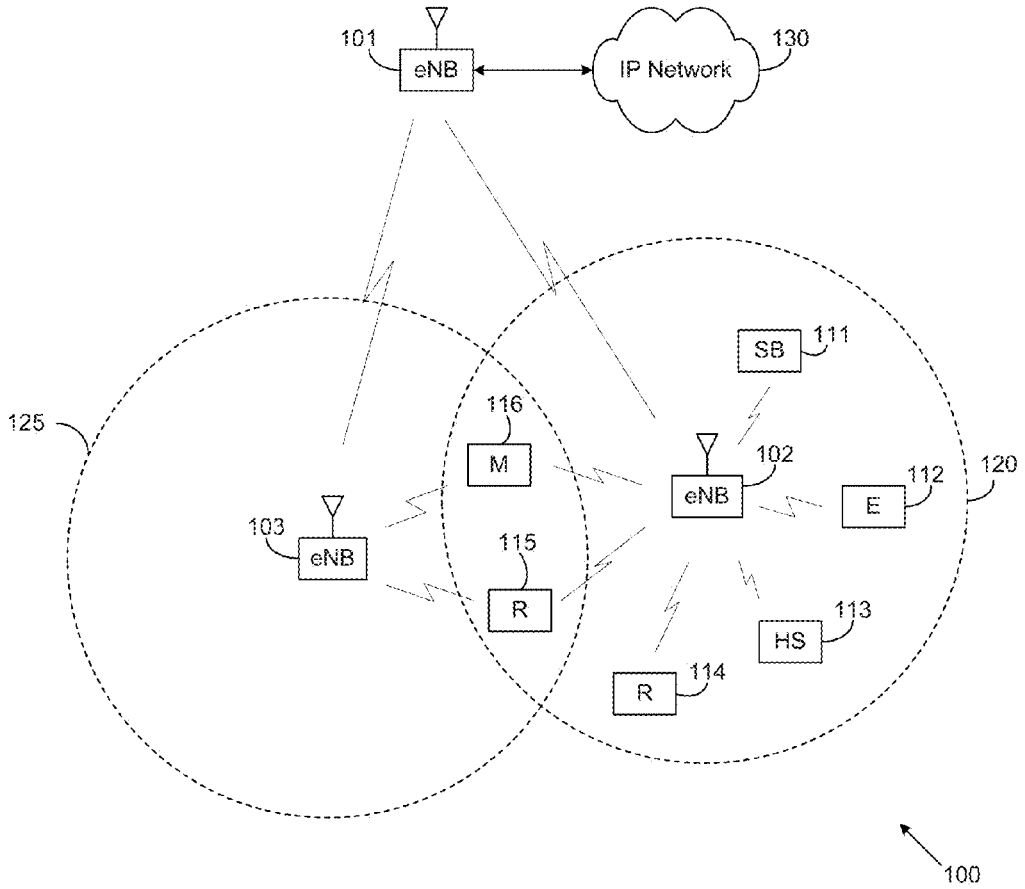
FIG. 1 illustrates an example wireless system in accordance with this disclosure.

FIG. 1 illustrates an example wireless network 100 according to this disclosure. The embodiment of the wireless network 100 shown in FIG. 1 is for illustration only. Other embodiments of the wireless network 100 could be used without departing from the scope of this disclosure.

As shown in FIG. 1, the wireless network 100 includes an eNodeB (eNB) 101, an eNB 102, and an eNB 103. The eNB 101 communicates with the eNB 102 and the eNB 103. The eNB 101 also communicates with at least one Internet Protocol (IP) network 130, such as the Internet, a proprietary IP network, or other data network.

The eNB 102 provides wireless broadband access to the network 130 for a first plurality of user equipments (UEs) within a coverage area 120 of the eNB 102. The first plurality of UEs includes a UE 111, which may be located in a small business (SB); a UE 112, which may be located in an enterprise (E); a UE 113, which may be located in a WiFi hotspot (HS); a UE 114, which may be located in a first residence (R); a UE 115, which may be located in a second residence (R); and a UE 116, which may be a mobile device (M) like a cell phone, a wireless laptop, a wireless PDA, or the like. The eNB 103 provides wireless broadband access to the network 130 for a second plurality of UEs within a coverage area 125 of the eNB 103. The second plurality of UEs includes the UE 115 and the UE 116. In some embodiments, one or more of the eNBs 101-103 may communicate with each other and with the UEs 111-116 using 5G, LTE, LTE-A, WiMAX, WiFi, or other wireless communication techniques.

Depending on the network type, other well-known terms may be used instead of "eNodeB" or "eNB," such as "base station" or "access point." For the sake of convenience, the terms "eNodeB" and "eNB" are used in this patent document to refer to network infrastructure components that provide wireless access to remote terminals. Also, depending on the network type, other well-known terms may be used instead of "user equipment" or "UE," such as "mobile station," "subscriber station," "remote terminal," "wireless terminal," or "user device." For the sake of convenience, the terms "user equipment" and "UE" are used in this patent document to refer to remote wireless equipment that wirelessly accesses an eNB, whether the UE is a mobile device (such as a mobile telephone or smartphone) or is normally considered a stationary device (such as a desktop computer or vending machine).

Dotted lines show the approximate extents of the coverage areas 120 and 125, which are shown as approximately circular for the purposes of illustration and explanation only. It should be clearly understood that the coverage areas associated with eNBs, such as the coverage areas 120 and 125, may have other shapes, including irregular shapes, depending upon the configuration of the eNBs and variations in the radio environment associated with natural and man-made obstructions.

As described in more detail below, the eNBs 101-103 and/or the UEs 111-116 could include one or more mixed-order bandpass frequency selective surface (FSS) lenses.

Although FIG. 1 illustrates one example of a wireless network 100, various changes may be made to FIG. 1. For example, the wireless network 100 could include any number of eNBs and any number of UEs in any suitable arrangement. Also, the eNB 101 could communicate directly with any number of UEs and provide those UEs with wireless broadband access to the network 130. Similarly, each eNB 102-103 could communicate directly with the network 130 and provide UEs with direct wireless broadband access to the network 130. Further, the eNB 101, 102, and/or 103 could provide access to other or additional external networks, such as external telephone networks or other types of data networks.

Figure 2:
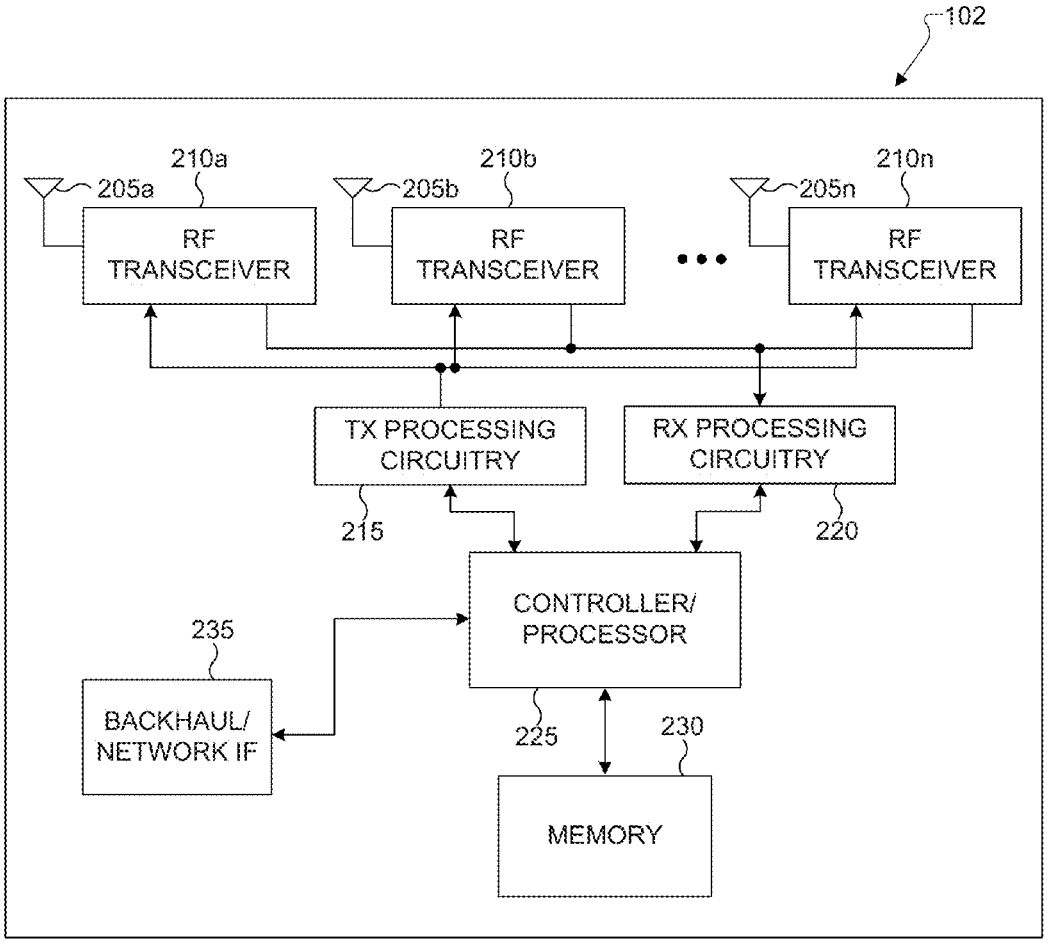
FIG. 2 illustrates an example evolved Node B (eNB) according to this disclosure.

FIG. 2 illustrates an example eNB 102 according to this disclosure. The embodiment of the eNB 102 illustrated in FIG. 2 is for illustration only, and the eNBs 101 and 103 of FIG. 1 could have the same or similar configuration. However, eNBs come in a wide variety of configurations, and FIG. 2 does not limit the scope of this disclosure to any particular implementation of an eNB.

As shown in FIG. 2, the eNB 102 includes multiple antennas 205*a*-205*n*, multiple RF transceivers 210*a*-210*n*, transmit (TX) processing circuitry 215, and receive (RX) processing circuitry 220. The eNB 102 also includes a controller/processor 225, a memory 230, and a backhaul or network interface 235.

The RF transceivers 210*a*-210*n* receive from the antennas 205*a*-205*n* incoming RF signals, such as signals transmitted by UEs in the wireless network 100. The RF transceivers 210*a*-210*n* down-convert the incoming RF signals to generate IF or baseband signals. The IF or baseband signals are sent to the RX processing circuitry 220, which generates processed baseband signals by filtering, decoding, and/or digitizing the baseband or IF signals. The RX processing circuitry 220 transmits the processed baseband signals to the controller/processor 225 for further processing.

The TX processing circuitry 215 receives analog or digital data (such as voice data, web data, e-mail, or interactive video game data) from the controller/processor 225. The TX processing circuitry 215 encodes, multiplexes, and/or digitizes the outgoing baseband data to generate processed baseband or IF signals. The RF transceivers 210*a*-210*n* receive the outgoing processed baseband or IF signals from the TX processing circuitry 215 and up-converts the baseband or IF signals to RF signals that are transmitted via the antennas 205*a*-205*n*.

The controller/processor 225 can include one or more processors or other processing devices that control the overall operation of the eNB 102. For example, the controller/processor 225 could control the reception of forward channel signals and the transmission of reverse channel signals by the RF transceivers 210*a*-210*n*, the RX processing circuitry 220, and the TX processing circuitry 215 in accordance with well-known principles. The controller/processor 225 could support additional functions as well, such as more advanced wireless communication functions. For instance, the controller/processor 225 could support beam forming or directional routing operations in which outgoing signals from multiple antennas 205*a*-205*n* are weighted differently to effectively steer the outgoing signals in a desired direction. Any of a wide variety of other functions could be supported in the eNB 102 by the controller/processor 225. In some embodiments, the controller/processor 225 includes at least one microprocessor or microcontroller.

The controller/processor 225 is also capable of executing programs and other processes resident in the memory 230, such as a basic OS. The controller/processor 225 can move data into or out of the memory 230 as required by an executing process.

The controller/processor 225 is also coupled to the backhaul or network interface 235. The backhaul or network interface 235 allows the eNB 102 to communicate with other devices or systems over a backhaul connection or over a network. The interface 235 could support communications over any suitable wired or wireless connection(s). For example, when the eNB 102 is implemented as part of a cellular communication system (such as one supporting 5G, LTE, or LTE-A), the interface 235 could allow the eNB 102 to communicate with other eNBs over a wired or wireless backhaul connection. When the eNB 102 is implemented as an access point, the interface 235 could allow the eNB 102 to communicate over a wired or wireless local area network or over a wired or wireless connection to a larger network (such as the Internet). The interface 235 includes any suitable structure supporting communications over a wired or wireless connection, such as an Ethernet or RF transceiver.

The memory 230 is coupled to the controller/processor 225. Part of the memory 230 could include a RAM, and another part of the memory 230 could include a Flash memory or other ROM.

As described in more detail below, the eNB 102 could include one or more mixed-order bandpass FSS lenses.

Although FIG. 2 illustrates one example of eNB 102, various changes may be made to FIG. 2. For example, the eNB 102 could include any number of each component shown in FIG. 2. As a particular example, an access point could include a number of interfaces 235, and the controller/processor 225 could support routing functions to route data between different network addresses. As another particular example, while shown as including a single instance of TX processing circuitry 215 and a single instance of RX processing circuitry 220, the eNB 102 could include multiple instances of each (such as one per RF transceiver). Also, various components in FIG. 2 could be combined, further subdivided, or omitted, and additional components could be added according to particular needs.

Figure 3:
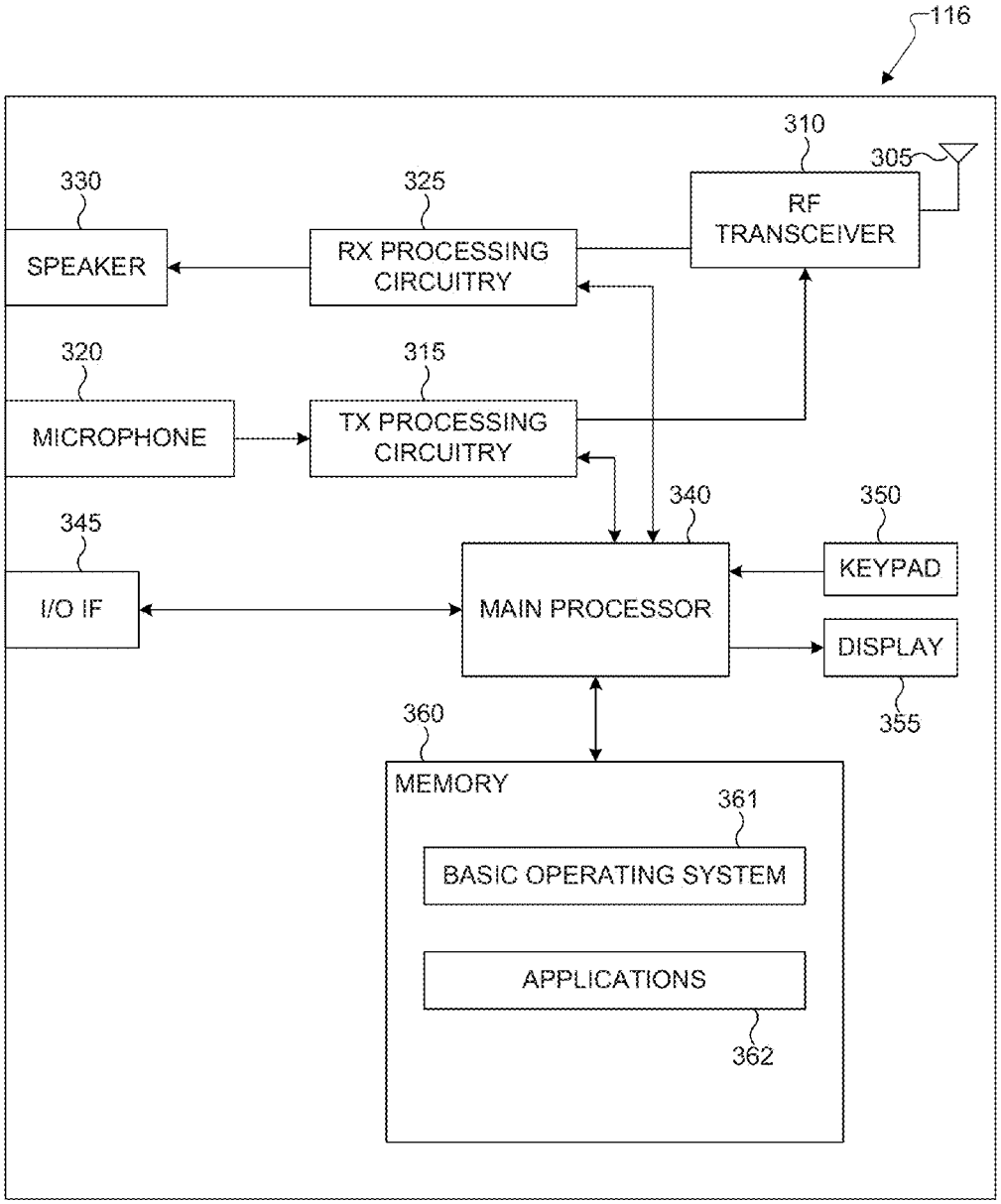
FIG. 3 illustrates an example user equipment (UE) according to this disclosure.

FIG. 3 illustrates an example UE 116 according to this disclosure. The embodiment of the UE 116 illustrated in FIG. 3 is for illustration only, and the UEs 111-115 of FIG. 1 could have the same or similar configuration. However, UEs come in a wide variety of configurations, and FIG. 3 does not limit the scope of this disclosure to any particular implementation of a UE.

As shown in FIG. 3, the UE 116 includes an antenna 305, a radio frequency (RF) transceiver 310, transmit (TX) processing circuitry 315, a microphone 320, and receive (RX) processing circuitry 325. The UE 116 also includes a speaker 330, a main processor 340, an input/output (I/O) interface (IF) 345, a keypad 350, a display 355, and a memory 360. The memory 360 includes a basic operating system (OS) program 361 and one or more applications 362.

The RF transceiver 310 receives from the antenna 305 an incoming RF signal transmitted by an eNB of the network 100. The RF transceiver 310 down-converts the incoming RF signal to generate an intermediate frequency (IF) or baseband signal. The IF or baseband signal is sent to the RX processing circuitry 325, which generates a processed baseband signal by filtering, decoding, and/or digitizing the baseband or IF signal. The RX processing circuitry 325 transmits the processed baseband signal to the speaker 330 (such as for voice data) or to the main processor 340 for further processing (such as for web browsing data).

The TX processing circuitry 315 receives analog or digital voice data from the microphone 320 or other outgoing baseband data (such as web data, e-mail, or interactive video game data) from the main processor 340. The TX processing circuitry 315 encodes, multiplexes, and/or digitizes the outgoing baseband data to generate a processed baseband or IF signal. The RF transceiver 310 receives the outgoing processed baseband or IF signal from the TX processing circuitry 315 and up-converts the baseband or IF signal to an RF signal that is transmitted via the antenna 305.

The main processor 340 can include one or more processors or other processing devices and execute the basic OS program 361 stored in the memory 360 in order to control the overall operation of the UE 116. For example, the main processor 340 could control the reception of forward channel signals and the transmission of reverse channel signals by the RF transceiver 310, the RX processing circuitry 325, and the TX processing circuitry 315 in accordance with well-known principles. In some embodiments, the main processor 340 includes at least one microprocessor or microcontroller.

The main processor 340 is also capable of executing other processes and programs resident in the memory 360. The main processor 340 can move data into or out of the memory 360 as required by an executing process. In some embodiments, the main processor 340 is configured to execute the applications 362 based on the OS program 361 or in response to signals received from eNBs or an operator. The main processor 340 is also coupled to the I/O interface 345, which provides the UE 116 with the ability to connect to other devices, such as laptop computers and handheld computers. The I/O interface 345 is the communication path between these accessories and the main processor 340.

The main processor 340 is also coupled to the keypad 350 and the display 355. The operator of the UE 116 can use the keypad 350 to enter data into the UE 116. The display 355 may be a liquid crystal display or other display capable of rendering text and/or at least limited graphics, such as from web sites.

The memory 360 is coupled to the main processor 340. Part of the memory 360 could include a random access memory (RAM), and another part of the memory 360 could include a Flash memory or other read-only memory (ROM).

As described in more detail below, the UE 116 could include one or more mixed-order bandpass FSS lenses.

Although FIG. 3 illustrates one example of UE 116, various changes may be made to FIG. 3. For example, various components in FIG. 3 could be combined, further subdivided, or omitted, and additional components could be added according to particular needs. As a particular example, the main processor 340 could be divided into multiple processors, such as one or more central processing units (CPUs) and one or more graphics processing units (GPUs). Also, while FIG. 3 illustrates the UE 116 configured as a mobile telephone or smartphone, UEs could be configured to operate as other types of mobile or stationary devices.

Embodiments of this disclosure recognize and take into account the fact that lenses may provide several significant improvements to antennas used in communication systems, including microwave and millimeter wave (MMW) communication systems. These improvements can include increased antenna directivity for specific point-to-point communications and improved link availability; increased antenna gains for better signal-to-noise ratios, data capacities, and link reliabilities; reduced antenna side-lobes for more effective use of antenna radiation patterns and for less interference from other radios; and reduced antenna losses for lower system power consumptions. Lenses provide these improvements while maintaining the capability of antenna pattern beam steering, which is useful in many microwave and MMW communication systems. Further, these enhancements can be realized using only passive structures to avoid the complexity and energy losses associated with approaches where active devices are used for such improvements.

Embodiments of this disclosure also recognize and take into account the fact that phase shifts realized by a frequency selective surface (FSS) can be used to design planar lenses. In these lenses, a wide range of phase shifts may be covered by tuning high-order bandpass FSSs. For example, cascading multiple first-order FSSs with a spacing of a quarter wavelength between each panel can increase the overall thickness of the FSS and enhance the sensitivity of the frequency response to the angle and polarization of incidence of EM waves. Advances in FSS technology also enable the synthesis of low-profile high-order bandpass FSSs that are composed entirely of non-resonant periodic structures. One type of FSS uses a pair of inductive and capacitive layers to increase one or more orders of the bandpass response. However, this stacked topology with multiple bonding layers constitutes a bottleneck for commercial MMW applications due to its high cost and to performance degradations caused by multiple bonding layers.

Embodiments of this disclosure further recognize and take into account the fact that certain planar lens technologies for microwave or MMW systems have critical drawbacks, which hamper their practical applications. These drawbacks can include the following:

- bulk and size—to obtain phase changes for collimation or focusing, fully dielectric lenses are thick, bulky, and heavy; and
- complexity—construction that involves multiple metal and dielectric layers, alternating metal layers of different and complicated layout designs, and bonding layers between dielectric layers having dielectric and electrical properties inconsistent with other dielectric layers increase cost, weight, and insertion losses of planar lenses.

Additionally, shortcomings in certain high-order bandpass FSS lenses may include the following:

- high fabrication costs due to a large number of substrate, metal, and bonding layers;
- high ohmic losses due to a large number of metallic traces;
- high dielectric losses due to a large number of substrate and bonding layers; and
- poor fabrication tolerances due to mismatches in material properties between bonding layers and dielectric layers.

Accordingly, various embodiments of this disclosure provide low-cost, low-profile planar lenses. The lenses of this disclosure can be used in various ways, such as for gain/pattern enhancements of radiating elements (such as antennas) operating in wireless communication platforms like UEs and eNBs. Moreover, various embodiments of this disclosure provide thinner configurations of planar lenses to cover elements with a reduced loading complexity. Further, the lenses of various embodiments of this disclosure may enhance system gains at RF front ends without using active devices and thus improve signal-to-noise ratios (SNRs). In addition, the increase in the power level of a received signal may allow for a reduction of power consumption in the overall system and more reliable wireless connections.

In various embodiments of this disclosure, planar lenses employ a mixed-order bandpass filter response, which may allow for a reduction in the number of substrates and metal layers in the lenses while maintaining phase shift targets. In some embodiments, the planar lenses of the present disclosure employ a single-substrate spatial mixed-order bandpass filter including one dielectric substrate and two metal layers. This approach allows for the reduction in the number of substrate and metal layers while maintaining desired goals for phase shift. For example, some conventional lenses employ a third-order bandpass filter response, four substrates, five metal layers, and three bonding layers (where both inductive and capacitive layers are used). However, to achieve a comparable or larger amount of phase shift, the single-substrate spatial mixed-order bandpass lens of the present disclosure uses one substrate and two metal layers and may not require bonding layers.

Figure 4:
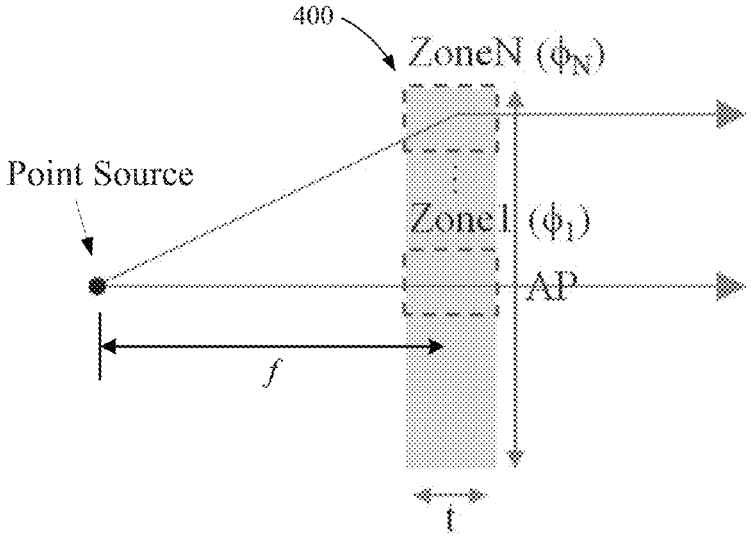
FIG. 4 illustrates an example planar frequency selective surface (FSS) lens in accordance with this disclosure.

FIG. 4 illustrates an example planar FSS lens 400 in accordance with this disclosure. In this illustrative example, a phase shift is realized by the phase response of an FSS of the lens 400. An aperture of the lens 400 is split into multiple different zones (such as Zone1, Zone2, . . . , ZoneN). As depicted in FIG. 4, rays passing through the different zones of the FSS experience different amounts of phase shift. More specifically, the phase shift experienced by rays passing through the lens 400 decreases the further the rays are from the center of the lens 400, so there are higher phase shifts near the center of the lens 400 and lower phase shifts near the edges of the lens 400.

It may be necessary or desirable to reduce the focal length f of the lens 400 for compact wireless devices having small form factor demands, such as UEs. Reducing the focal length can involve maximizing the difference in phase shifts across the lens 400 (where $\Delta\phi_{diff}=|\phi_1-\phi_N|$). The value of $\Delta\phi_{diff}$ is determined by the tunable range of the phase shift of FSS elements within the pass band of the FSS. The lens 400 may acquire the tunable range by modifying the sizes of the FSS elements slightly according to the number of zones.

Other design parameters for the lens 400 include the size of the lens aperture (AP), the thickness (t) of the lens 400, and the size of FSS unit cells. As the aperture size increases, the focusing gain increases, but the focal length f also increases when $\Delta\phi_{diff}$ is fixed. The lens thickness is related to the sensitivity of the lens 400 to the angle of incidence of EM waves. In addition, smaller FSS unit cells lead to finer focusing resolutions of the lens 400 but can require better tolerances of a fabrication process. The aforementioned design parameters in the lens 400 may be determined by considering the tradeoffs among performance, size, and fabrication conditions.

Figure 5:
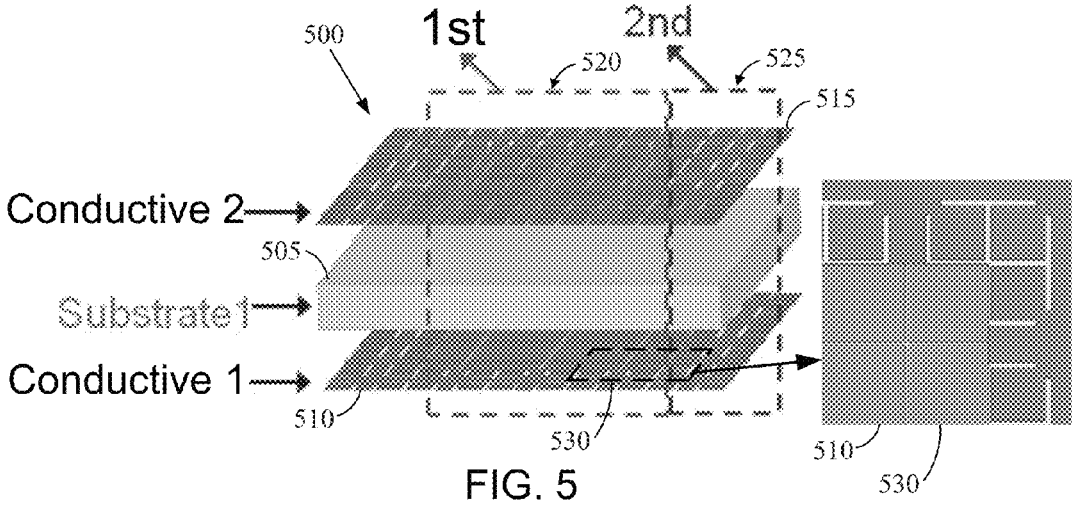
FIG. 5 illustrates an exploded view of an example topology of a mixed-order bandpass FSS lens in accordance with this disclosure.

FIG. 5 illustrates an exploded view of an example topology of a mixed-order bandpass FSS lens 500 in accordance with this disclosure. In this illustrative example, the lens 500 includes a substrate layer 505 and two conductive element layers 510 and 515. As is described in greater detail below, the lens 500 is mixed-order in that the lens 500 includes a capacitively-loaded first-order bandpass FSS portion 520 and a second-order bandpass FSS portion 525. Portion 530 of layer 510 is enlarged to illustrate details of the patterns of conductive elements present in layer 510, which is described in greater detail below.

Figure 6A:
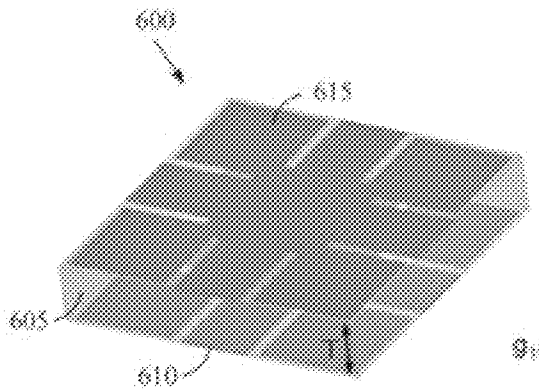
FIGS. 6A and 6B illustrate perspective views of an example topology of a unit cell for a second-order bandpass FSS in accordance with this disclosure.
Figure 6B:
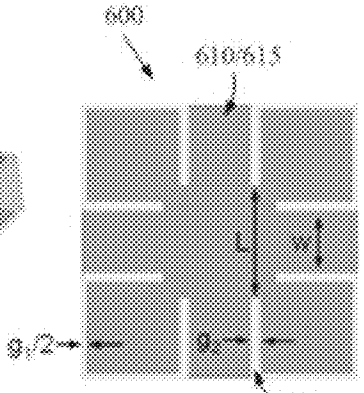

FIGS. 6A and 6B illustrate perspective views of an example topology of a unit cell 600 for a second-order bandpass FSS in accordance with this disclosure. In this illustrative embodiment, the unit cell 600 is an example of a unit cell present within a cross section of the second-order bandpass FSS portion 525 of the lens 500 in FIG. 5. In FIG. 6A, the unit cell 600 is depicted in a side view, with a portion 605 of the substrate layer 505 present in the unit cell 600 depicted as being transparent so that the structure of a conductive element 610 in the conductive element layer 510 is viewable. In FIG. 6B, the unit cell 600 is depicted in a top and/or bottom view, with the structure of the conductive element 610 and/or a conductive element 615 distinguished from the underlying portion 605 of the substrate layer 505.

The unit cell 600 is a second-order bandpass FSS. For example, the combination of a dielectric in the substrate portion 605 and metal in the conductive elements 610 and 615 provides a bandpass filter response for EM waves that propagate through the unit cell 600. Each side of the unit cell 600 provides a single-order bandpass FSS such that the unit cell 600 is a second-order bandpass FSS. Several such unit cells 600 form the second-order bandpass FSS portion 525 of the lens 500. For instance, the outer portions of the lens 500 may employ the second-order bandpass FSS. Different amounts of phase shifts and tuning of phase shifts may be obtainable by varying properties of the unit cell 600. These properties include, for example, the size of the conductive elements 610/615 in the conductive element layers 510/515, the thickness of the conductive elements 610/615 in the conductive element layers 510/515, $g_1$ (the size(s) of the gap between adjacent conductive elements 610/615 in a conductive element layer 510/515), $g_2$ (the size(s) of the gaps within the conductive elements 610/615), L (the length between gaps on opposite ends of the conductive element), w (the width between gaps on the same end of the conductive element), and/or other properties of the structure of the conductive elements 610/615 in the unit cell 600.

Note that the structure of the conductive elements 610 and 615 shown in FIGS. 6A and 6B is for the purpose of illustrating one example of a second-order bandpass FSS. Other suitable structure shapes may be utilized (such as rectangles, triangles, and ellipses). Additionally, any number of different sizes, positions, and number of gaps within the conductive elements 610/615 may be suitably employed in accordance with the principles of the present disclosure.

Figure 7A:
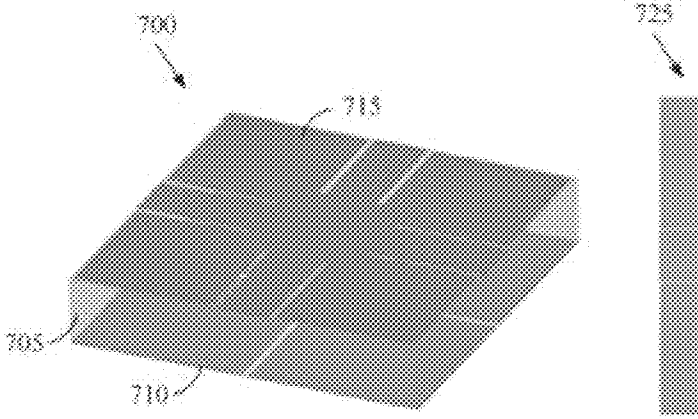
FIGS. 7A through 7C illustrate perspective views of an example topology of a unit cell for a capacitively-loaded, first-order bandpass FSS in accordance with this disclosure.
Figure 7C:
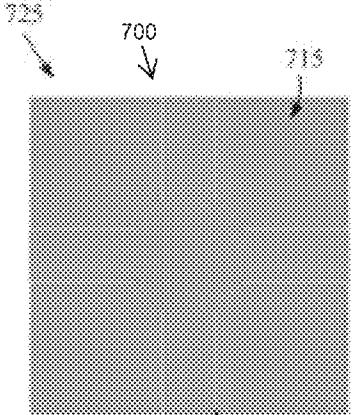
Figure 7B:
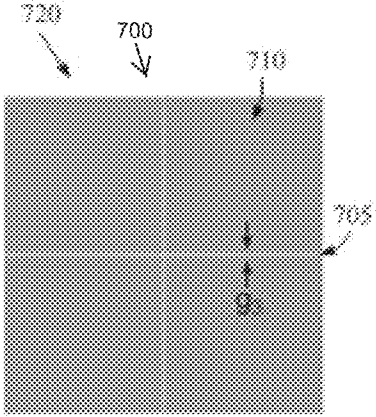

FIGS. 7A through 7C illustrate perspective views of an example topology of a unit cell 700 for a capacitively-loaded, first-order bandpass FSS in accordance with this disclosure. In this illustrative embodiment, the unit cell 700 is an example of a unit cell present within a cross section of the capacitively-loaded, first-order bandpass FSS portion 520 of the lens 500 in FIG. 5.

In FIG. 7A, the unit cell 700 is depicted in a side view, with a portion 705 of the substrate layer 505 present in the unit cell 700 depicted as transparent so that the structure of conductive elements 710 in the conductive element layer 510 is viewable. In FIG. 7B, the unit cell 700 is depicted from one side 720 (such as a top and/or bottom view), with the structure of the conductive elements 710 distinguished from the underlying portion 705 of the substrate layer 505. In FIG. 7C, the unit cell 700 is depicted from the other side 725 (such as a bottom and/or top side), with the structure of conductive elements 715 again distinguished from the underlying portion 705 of the substrate layer 505. In various embodiments, the conductive elements 710/715 have the same structure as the conductive elements 610/615 in the unit cell 600.

The unit cell 700 is a capacitively-loaded, first-order bandpass FSS. For example, the combination of a dielectric in the substrate portion 705 and metal in the conductive elements 710 provides a capacitive filter response for EM waves that propagate through the side 720 of the unit cell 700. For example, the structure of the conductive elements may have a patch structure, such as a rectangular shape, which provides the capacitive filter response for EM waves that propagate through the side 720 of the unit cell 700. Similarly, as discussed above with regard to FIGS. 6A and 6B, the combination of the dielectric in the substrate portion 705 and metal in the conductive elements 715 provides a bandpass filter response for EM waves that propagate through the side 725 of the unit cell 700. Thus, the unit cell 700 is a first-order bandpass FSS that is "capacitively loaded."

Several such unit cells 700 form the capacitively-loaded, first-order bandpass FSS portion 520 of the lens 500. For instance, the inner portions of the lens 500 may employ the capacitively-loaded, first-order bandpass FSS. Different amounts of phase shifts and tuning of phase shifts may be obtainable by varying properties of the unit cell 700. As discussed above with regard to FIGS. 6A and 6B, these properties include, for example, size, thickness, $g_1$, $g_2$, L, w, and/or other properties of the structure of the conductive elements 710/715 in the unit cell 700. Additionally, the side 720 includes the property $g_3$, which refers to the size(s) of the gap between adjacent conductive elements 710 in the side 720 and/or in the portion 525 of the layer 510 of the lens 500.

Note that the illustrations of the unit cells 600 and 700 are examples only and for the purpose of showing the structure and arrangement of individual conductive elements within their respective layers. As illustrated in FIG. 5, the lens 500 includes multiple unit cells, and the substrate layer 505 is substantially contiguous or unbroken across the multiple unit cells.

Figure 8:
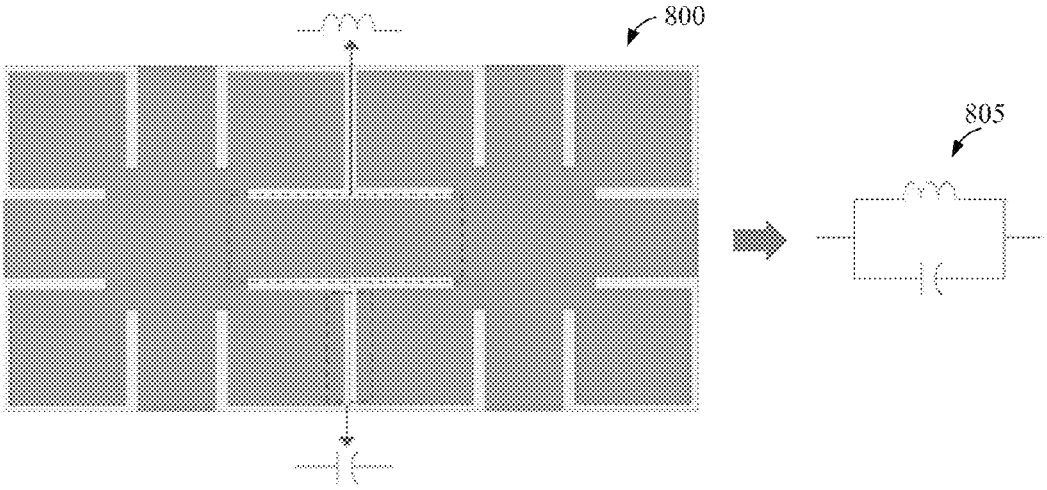
FIG. 8 illustrates an example topology and equivalent circuit model of a bandpass FSS in accordance with this disclosure.

FIG. 8 illustrates an example topology and equivalent circuit model of a bandpass FSS 800 in accordance with this disclosure. In this illustrative example, the FSS 800 may be a portion of either side of the lens 500 having a bandpass filter metal layer structure, such as the layer 515 or the portions of the layer 510 in the second-order portion 525. As shown in FIG. 8, the combination of the dielectric in the substrate layer 505 and the metal in the conductive element layer(s) 510 and/or 515 provides a bandpass filter response for EM waves that propagate through the bandpass FSS 800. A circuit model 805 illustrates a shunt resonator including a shunt inductor and shunt capacitor realized on a single surface including conductive elements and dielectric gaps.

Figure 9A:
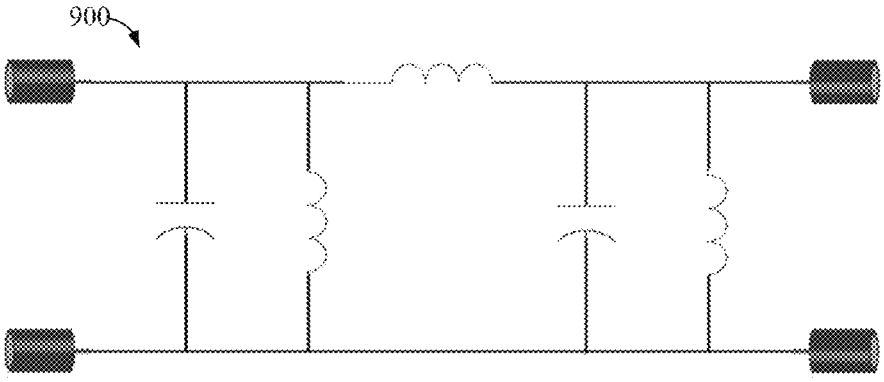
FIGS. 9A and 9B illustrate equivalent circuit models for an example second-order bandpass FSS and an example capacitively-loaded, first-order bandpass FSS, respectively, of an FSS lens in accordance with this disclosure.
Figure 9B:
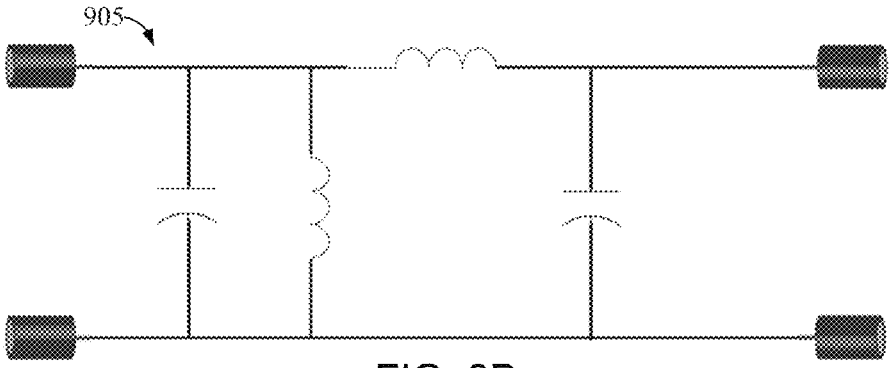

FIGS. 9A and 9B illustrate equivalent circuit models for an example second-order bandpass FSS and an example capacitively-loaded, first-order bandpass FSS, respectively, of an FSS lens in accordance with this disclosure. In this illustrative example, a circuit model 900 shows the circuit equivalence of the phase shift obtained by EM waves that propagate through the second-order bandpass FSS bandpass portions of an FSS lens, such as the portion 525 in the lens 500. As depicted, the model 900 includes two bandpass filter responses (a capacitor in parallel with an inductor). A circuit model 905 shows the circuit equivalence of the phase shift obtained by EM waves that propagate through a capacitively-loaded, first-order bandpass FSS, such as the portion 520 in the lens 500. As depicted, the model 905 includes one bandpass filter response (a capacitor in parallel with an inductor) on one side, with the other side having a capacitive filter response. The circuit models 900 and 905 are for the purpose of illustrating an equivalent or approximate representation of the phase shift properties of the different portions of the FSS lens 500.

The capacitive loading in the capacitively-loaded first-order bandpass FSS lowers the overall phase shift values for the portion 520 of the FSS lens 500 at the operating frequency of the lens 500. The capacitive loading can allow the portion 520 of the FSS lens 500 to cover a new tunable range of phase shifts that may not be covered by a bandpass-only spatial FSS. For example, the tunable range of phase shifts for different-order bandpass spatial FSSs may overlap. As a result, a mixed-order bandpass-only FSS may not provide additional tunable ranges of phase shifts beyond that of the highest order in the bandpass FSS. For instance, the tunable range of phase shifts for first- and second-order bandpass FSSs may be encompassed within the tunable range of phase shifts for a third-order bandpass FSS. On the other hand, the capacitive loading of the portion 520 of the FSS lens 500 modifies the slope of the lower cutoff frequency response, which moves the tunable range of phase shifts for the capacitively-loaded, first-order FSS portion 520 of the FSS lens 500 to cover a range that may not be covered by the second-order bandpass FSS portion 525 of the FSS lens 500.

Combining the capacitively-loaded, first-order bandpass FSS portion 520 with the second-order bandpass FSS portion 525 to form a mixed-order bandpass FSS lens 500 provides enhancements in the tunable range of phase shifts of the FSS lens structure without increasing the order of the filter response. In other words, the capacitively-loaded first- and second-order FSS lens of the present disclosure may provide a tunable range of phase shifts comparable to that of a third-order bandpass filter, which is unexpected for bandpass filters. In addition, the use of a single substrate, while providing a comparable tunable range of phase shifts as a third-order bandpass FSS lens (which may need multiple substrates and bonding layers), provides several advantages as described herein.

Figure 10A:
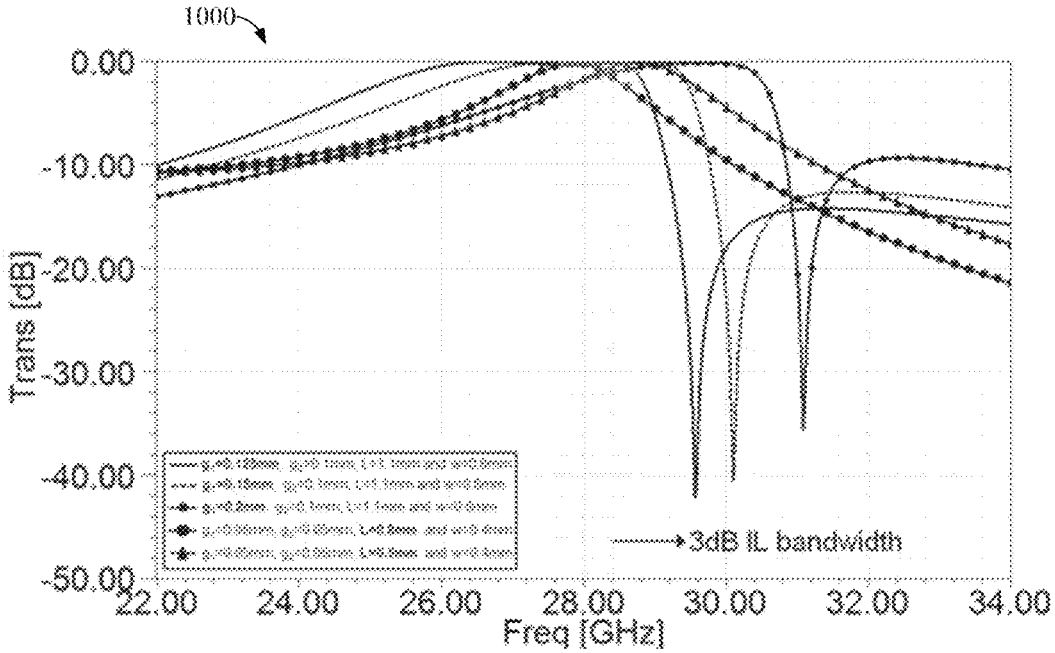
FIGS. 10A and 10B illustrate example magnitude and phase plots, respectively, of transmittance of a mixed-order bandpass FSS lens in accordance with this disclosure.
Figure 10B:
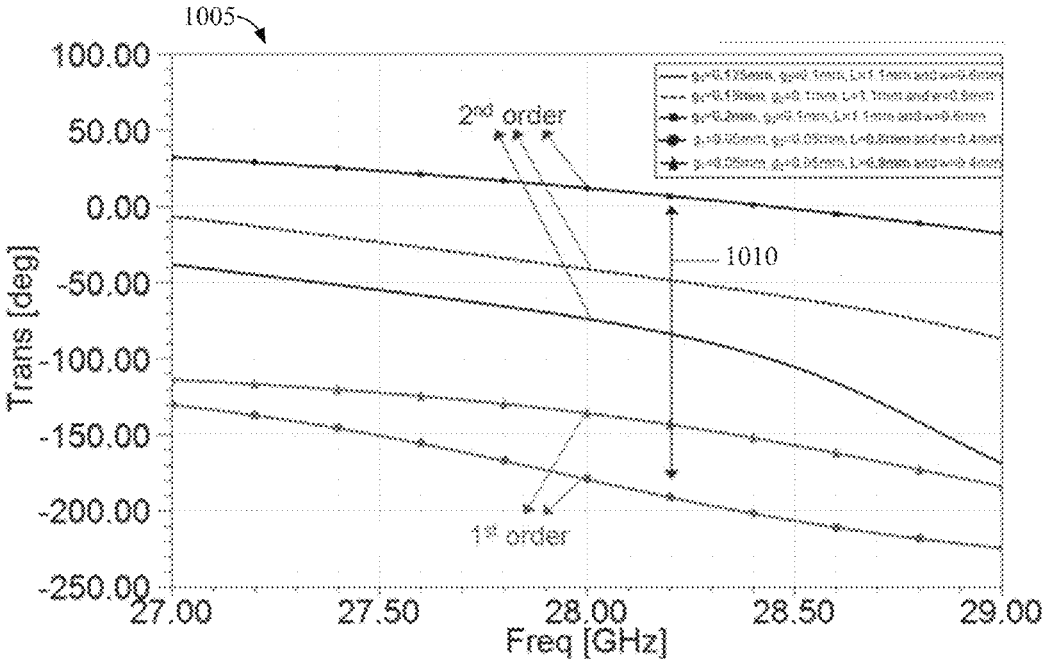

FIGS. 10A and 10B illustrate example magnitude and phase plots, respectively, of transmittance of a mixed-order bandpass FSS lens in accordance with this disclosure. FIG. 10A illustrates a plot 1000 of the magnitude response of different portions of the FSS lens 500. FIG. 10B illustrates a plot 1005 of the frequency response of different portions of the FSS lens 500. As illustrated, the phase response for the first-order portions of the FSS lens 500 does not overlap the phase response for the second-order portions of the FSS lens 500. As a result, a tunable range 1010 of the mixed-order FSS lens 500 is increased. In this example, the tunable range 1010 of the FSS lens 500 may be about 200°. This tunable range may be greater than some third-order bandpass FSS lenses, which may employ much larger numbers of metal, substrate, and/or bonding layers. Accordingly, the mixed-order bandpass FSS lens 500 can achieve desired goals of attaining suitable phase shift tunable ranges while reducing the size, thickness, and/or machining limitations of existing lenses.

In particular embodiments, the lens 500 can represent a single-substrate mixed-order bandpass FSS lens designed for a 28.2 GHz operating frequency with a unit cell size of 2.7 mm, and the dielectric constant and thickness of the substrates (Rogers 3003) are 3 mm and 0.5 mm, respectively. In these embodiments, the lens 500 provides sub-wavelength filtering. For example, the size or lateral dimension of the conductive elements and the overall thickness of the lens may be less than a wavelength of the operating frequency designed for spatial phase shifting by the lens 500.

To achieve different steps of phase shift, design parameters (such as $g_1$, $g_2$, $g_3$, w, and L) are appropriately tuned for the second-order and capacitively-loaded first-order bandpass portions. Values for the design parameters of the FSS lens 500 for the 28.2 GHz design example are listed in the legend for the plots 1000 and 1005. The values and dimensions described above are examples only and are not limitations on different dimensions that may be utilized in accordance with embodiments of this disclosure. For example, the sizes, number, and/or gaps of the conductive elements in any of the layers may be increased or decreased based on various factors, such as phase shifts, lens thicknesses, and/or machining tolerances.

The mixed-order bandpass FSS lens 500 of the present disclosure may utilize fewer metal and dielectric layers than that of existing planar lenses while providing comparable or better ranges of spatial phase shifts. First-order capacitively-loaded elements may be placed in the center of the FSS lens 500, while second-order elements may be placed around the outside of the lens. The higher absolute phase delay of the first-order capacitively-loaded elements is utilized in the central portion of the lens 500 to provide a larger phase delay for collimation or focusing EM waves near the center of the lens. The second-order elements towards the outer region of the lens 500 provide less absolute phase delay but contribute to a wider range of phase delay for tuning the collimation or focusing of the planar lens 500.

Depending on the implementation, advantages of using the mixed-order bandpass FSS lens of this disclosure may include:

- lower fabrication costs due to a single substrate layer;
- lower fabrication costs due to the removal of the need for bonding layers;
- lower dielectric losses due to smaller numbers of substrate and bonding layers; and
- lower ohmic losses due to smaller numbers of metal or conductive layers.

In various embodiments, the FSS lenses can enhance coverage of a beam steering angle. For example, an FSS lens may include spatial phase shifters that cause waves propagating through the lens to be focused in any desired angle. In other embodiments, the FSS lenses may be utilized for beam broadening. This beam broadening can provide different levels of beam widths in different angles of radiation, which can enable multi-functional wireless communications (such as antenna diversity).

While various embodiments above describe FSS lenses as being used in conjunction with a patch array antenna, the FSS lenses of this disclosure can be used with any type or shape of antennas, such as horn antennas, monopole antennas, dipole antennas, and slot antennas. Additionally, while the shape of the FSS lens is illustrated in some of the figures as being flat, the FSS lens may be a curved, non-flat, and/or conformal lens. Also, while the use of metal for the conductive elements has been described, the conductive elements could be fabricated from other conductive material(s). Moreover, while the shape of the conductive elements is illustrated in some of the figures as being rectangular or square, the conductive elements may have other shapes. For example, the conductive elements may be hexagons, ellipses, circles, octagons, shapes with curved as well as straight edges, etc. In addition, the FSS lenses of this disclosure can be designed and fabricated for applications involving nearly any RF frequency range, from a few megahertz to multiple hundreds of gigahertz (such as 1 MHz to 300 GHz). Finally, the planar lenses of this disclosure can be fabricated and integrated with various platforms without strict fabrication process requirements. For instance, patterns in the planar lenses of this disclosure may only be two dimensional without requiring vertical structures.

Embodiments of this disclosure provide several significant improvements to antennas for wireless communication systems and other applications. For example, the FSS lenses of this disclosure can provide increased antenna gains and directivities, reduced antenna pattern side-lobes, and reduced antenna losses. These technical improvements provide a host of commercial and market advantages to any products and systems using such lenses. For instance, the FSS lenses of this disclosure can provide higher data throughputs or higher data capacities. The higher antenna gains of antennas with lenses produce higher signal-to-noise ratio values, and higher signal-to-noise ratio values provide higher data throughputs and higher data capacities.

As another example, the FSS lenses of this disclosure can provide better connection availabilities and better connection establishments. The FSS lenses can provide higher gains and stronger signals, and stronger signal levels between eNBs and UEs (or between other devices) provide more dependable initial establishment of connection between the devices. The FSS lenses of this disclosure can also provide more reliable wireless connections due to higher directivities and higher interference suppressions of antennas with lenses. Higher directivities of beam steering provide alignment of antenna patterns with communication paths or channels. Higher directivities and lower side-lobes also reduce the level of undesired signals intercepted along a desired communication path. The FSS lenses of this disclosure can further provide lower densities of eNBs with a greater range of UEs. The higher antenna gains allow UEs to operate farther from their eNBs with comparable transmitter powers, allowing fewer eNBs within a given area.

As yet another example, the FSS lenses of this disclosure can provide longer battery life for mobile or consumer products. The enhanced gain of a mobile antenna allows a reduction in transmitter power for comparable signal level. The improved gain of an eNB antenna provides a reduction in the power required for the receiver at a UE. The enhanced gain can reduce the electrical power consumed in the UE's electronics and allow longer operations between battery recharge cycles. The FSS lenses of this disclosure can also provide smaller products or products with more features and functions. The enhanced antenna directivities or gains provided allow the area used by the antenna to be reduced. The extra area may be re-allocated for components needed for other system functions or features, or the extra area may be used to reduce the overall size and volume of a UE or eNB.

Embodiments of this disclosure also provide several design and construction advantages. For example, the FSS lenses of this disclosure may reduce the number of both metal and dielectric layers used, which can simplify lens design and construction; reduce the lens cost, thickness (size), and weight; and reduce or eliminate extraneous materials in lens construction that may degrade performance.

Although this disclosure has been described with an example embodiment, various changes and modifications may be suggested to one skilled in the art. It is intended that this disclosure encompass such changes and modifications as fall within the scope of the appended claims.

What is claimed is:

1. An apparatus comprising:

a lens comprising a plurality of layers of conductive elements and a substrate layer;

a first of the layers of conductive elements comprising a first portion including conductive elements having a first structure different from a second structure of conductive elements in a second portion of the first layer;

wherein the lens is a mixed-order frequency selective surface (FSS) including:

a central portion that includes conductive elements of different structures on opposite sides of the substrate layer; and an outer portion that includes conductive elements having a same type of structure on opposite sides of the substrate layer.

2. The apparatus of claim 1, wherein:

the first layer is in contact with one side of the substrate layer; and conductive elements in a second of the layers of conductive elements are in contact with another side of the substrate layer and have the first structure.

3. The apparatus of claim 2, wherein a size and a thickness of the conductive elements having the first structure vary on the second of layer of conductive elements.

4. The apparatus of claim 1, wherein the lens comprises a first type of unit cell including:

at least one conductive element having the first structure is positioned on one side of the substrate layer; and conductive elements having the second structure positioned on another side of the substrate layer.

5. The apparatus of claim 4, wherein the first type of unit cell is configured to provide a capacitively-loaded bandpass filter response for electromagnetic waves passing through the first type of unit cell.

6. The apparatus of claim 5, wherein:

the lens further comprises a second type of unit cell including conductive elements positioned on opposite sides of the substrate layer and having the first structure; and the second type of unit cell is configured to provide a bandpass filter response for electromagnetic waves passing through the second type of unit cell.

7. The apparatus of claim 1, wherein a size and a thickness of the conductive elements having the first structure and the second structure vary on the first layer of conductive elements.

8. The apparatus of claim 1, wherein:

the first structure is a bandpass filter structure; and the second structure is a patch structure.

9. The apparatus of claim 1, wherein a range of phase shift responses for electromagnetic waves passing through the lens is based on at least a spacing between the conductive elements in the plurality of layers.

10. The apparatus of claim 1, wherein the lens includes only two layers of conductive elements and one substrate layer.

11. The apparatus of claim 1, wherein a lateral dimension of the conductive elements and a thickness of the lens are less than a wavelength of an operating frequency for spatial phase shifting.

12. A method comprising:

transmitting electromagnetic waves through a lens comprising a plurality of layers of conductive elements and a substrate layer, a first of the layers of conductive elements including a first portion comprising conductive elements having a first structure different from a second structure of conductive elements in a second portion of the first layer, wherein the lens is a mixed-order frequency selective surface (FSS) including:

a central portion that includes conductive elements of different structures on opposite sides of the substrate layer; and an outer portion that includes conductive elements having a same type of structure on opposite sides of the substrate layer.

13. The method of claim 12, wherein:

the first layer is in contact with one side of the substrate layer; and conductive elements in a second of the layers of conductive elements are in contact with another side of the substrate layer and have the first structure.

14. The method of claim 13, wherein the lens comprises a first type of unit cell including:

at least one conductive element having the first structure is positioned on one side of the substrate layer; and conductive elements having the second structure positioned on another side of the substrate layer.

15. The method of claim 14, wherein transmitting the electromagnetic waves through the lens comprises providing a capacitive filter response for electromagnetic waves passing through the first type of unit cell.

16. The method of claim 15, wherein:

the lens further comprises a second type of unit cell including conductive elements positioned on opposite sides of the substrate layer and having the first structure; and transmitting the electromagnetic waves through the lens comprises providing a bandpass filter response for electromagnetic waves passing through the second type of unit cell.

17. A system comprising:

a lens comprising a plurality of layers of conductive elements and a substrate layer, a first of the layers of conductive elements including a first portion comprising conductive elements having a first structure different from a second structure of conductive elements in a second portion of the first layer, wherein the lens is a mixed-order frequency selective surface (FSS) including:

a central portion that includes conductive elements of different structures on opposite sides of the substrate layer; and an outer portion that includes conductive elements having a same type of structure on opposite sides of the substrate layer;

at least one antenna configured to transmit or receive electromagnetic waves through the lens; and a transmitter or transceiver configured to generate signals for wireless transmission or receive signals transmitted wirelessly via the antenna.

18. The system of claim 17, wherein:

the first layer is in contact with one side of the substrate layer; and conductive elements in a second of the layers of conductive elements are in contact with another side of the substrate layer and have the first structure.

19. The system of claim 17, wherein the transmitter or transceiver, at least one antenna, and lens form part of a user equipment.

20. The system of claim 17, wherein the transmitter or transceiver, at least one antenna, and lens form part of an eNodeB.

* * * * *